US009434594B2

(12) United States Patent
Kaneko et al.

(10) Patent No.: US 9,434,594 B2
(45) Date of Patent: Sep. 6, 2016

(54) BEVERAGE DISPENSER

(71) Applicant: Panasonic Intellectual Property Management Co., Ltd., Osaka-shi, Osaka (JP)

(72) Inventors: Wataru Kaneko, Saitama (JP); Atsushi Makino, Saitama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/570,796

(22) Filed: Dec. 15, 2014

(65) Prior Publication Data

US 2015/0166319 A1 Jun. 18, 2015

(30) Foreign Application Priority Data

Dec. 16, 2013 (JP) ..... 2013-259109

(51) Int. Cl.
*B67D 1/08* (2006.01)
*B67D 1/07* (2006.01)
(Continued)

(52) U.S. Cl.
CPC ..... *B67D 1/07* (2013.01); *B67D 1/005* (2013.01); *B67D 1/0028* (2013.01); *B67D 1/0068* (2013.01); *B67D 1/0071* (2013.01); *B67D1/0406* (2013.01); *B67D 1/0864* (2013.01); *B67D 1/108* (2013.01); *B67D 1/1218* (2013.01); *B67D 1/1256* (2013.01)

(58) Field of Classification Search
CPC ..... B67D 1/07; B67D 1/005; B67D 1/0028; B67D 1/0068; B67D 1/0071; B67D 1/0406; B67D 1/0864; B67D 1/108; B67D 1/1218; B67D 1/1256; B67D 1/0044; B67D 1/0054; B67D 1/0834; B67D 1/0837; B67D 2210/00057
USPC ..... 222/148, 132, 129, 145.1, 145.2, 145.5; 239/104, 106, 398, 406, 418; 141/89, 141/90
See application file for complete search history.

(56) References Cited

U.S. PATENT DOCUMENTS 3,800,826 A * 4/1974 McCann ..... B67D 1/005 137/329.1
4,218,014 A * 8/1980 Tracy ..... B05B 7/0408 222/144.5

(Continued)

FOREIGN PATENT DOCUMENTS

JP 10-072099 3/1998
JP 2009-255942 11/2009
JP 2009255942 A * 11/2009

OTHER PUBLICATIONS

JP2009255942—English Translation, Dec. 26, 2015.*

*Primary Examiner* — J. Casimer Jacyna
*Assistant Examiner* — Benjamin R Shaw
(74) *Attorney, Agent, or Firm* — Hamre, Schumann, Mueller & Larson, P.C.

(57) ABSTRACT

A beverage dispenser is disclosed that includes a cleaning adapter configured to form a cleaning space in which each syrup nozzle and a dilution water supply section are located between the cleaning adapter and a multivalve and to clean each syrup nozzle by dilution water discharged from the dilution water supply section. A gap between the cleaning adapter and the multivalve is sealed above a nozzle distal end portion of each syrup nozzle and the dilution water supply section. The cleaning adapter includes discharge port 71 that discharges the dilution water after cleaning each syrup nozzle from a position higher than the nozzle distal end portion of each syrup nozzle.

4 Claims, 14 Drawing Sheets

(51) Int. Cl.

| | |
|---|---|
| *B67D 1/00* | (2006.01) |
| *B67D 1/04* | (2006.01) |
| *B67D 1/10* | (2006.01) |
| *B67D 1/12* | (2006.01) |

(56) References Cited

U.S. PATENT DOCUMENTS 4,526,322 A * 7/1985 Voorheis ..... B05B 1/34 239/404
4,863,068 A * 9/1989 Smith ..... B67D 1/005 137/607
5,002,204 A * 3/1991 Sakai ..... B67D 1/07 204/275.1
5,415,326 A * 5/1995 Durham ..... B67D 1/005 222/129.1
6,253,963 B1 * 7/2001 Tachibana ..... B67D 1/005 222/129.1
6,557,781 B2 * 5/2003 Kon ..... B05B 3/1064 239/104
6,871,761 B2 * 3/2005 Fox ..... B67D 1/0021 222/129.1
7,571,749 B2 * 8/2009 Stocchi ..... B67C 3/004 141/105
2005/0082313 A1 * 4/2005 Fox ..... B67D 1/0021 222/129.1

* cited by examiner

BEVERAGE DISPENSER

CROSS REFERENCE TO RELATED APPLICATION

This application is entitled and claims the benefit of Japanese Patent Application No. 2013-259109, filed on Dec. 16, 2013, the disclosure of which including the specification, drawings and abstract is incorporated herein by reference in its entirety.

TECHNICAL FIELD

The present invention relates to a beverage dispenser that selects one of a plurality of different types of syrup, mixes the selected syrup with dilution water such as carbonated water or cold water, and supplies the mixture from a multivalve.

BACKGROUND ART

Conventionally, this type of beverage dispenser selects a plurality of types of syrup (concentrated solutions) having different types of flavor, taste or the like, mixes the syrup with dilution water such as carbonated water or cold water, and supplies the mixture. In this case, the syrup or dilution water is discharged from a beverage discharge nozzle called "multivalve," and the syrup and dilution water are mixed and supplied to a cup.

This multivalve includes: a diffuser that is provided with a plurality of syrup nozzles for discharging syrup at a lower end portion of the diffuser and that is provided with a dilution water supply section around the circumference of the diffuser for discharging dilution water; a spout with a supply port opened at a lower end portion of the spout; and a base or the like for mounting the diffuser on a mounting plate or the like.

In this case, the spout is detachably mounted on the base and the mounting plate, and a gap through which the dilution water flows down is formed between the spout and the diffuser. An O-ring is attached above the dilution water supply section of the diffuser to seal the gap between the diffuser and the spout. The dilution water discharged from the dilution water supply section flows down through the gap between the spout and the diffuser and is discharged from the supply port. Meanwhile, the syrup nozzles are located above the supply port of the spout, the syrup discharged from the syrup nozzles is discharged toward the supply port below and collides with the dilution water therebelow (e.g., see Japanese Patent Application Laid-Open No. 10-72099 (hereinafter, referred to as "PTL 1")).

The syrup attaches to the distal end portion of the syrup nozzles and remains there, creating a state where bacteria easily reproduce. For this reason, the related art adopts a configuration in which a cleaning adapter is provided below the syrup nozzle, and dilution water is discharged there to clean the nozzle distal end portion (e.g., see Japanese Patent Application Laid-Open No. 2009-255942, hereinafter, referred to as "PTL 2").

CITATION LIST

Patent Literature

PTL 1
Japanese Patent Application Laid-Open No. 10-72099
PTL 2
Japanese Patent Application Laid-Open No. 2009-255942

SUMMARY OF INVENTION

Technical Problem

However, in the case of the cleaning apparatus as described in PTL 2, the dilution water discharged onto the cleaning adapter overflows from the gap between the nozzle portion and the cleaning adapter. For this reason, although the syrup nozzles located in the lower part can be cleaned, the dilution water does not sufficiently circulate the nozzle distal end portions of the syrup nozzles located in the upper part, which may cause insufficient cleaning.

The present invention has been made to solve the above-described technical problems of the related art and aims to provide a beverage dispenser that is provided with a multivalve including a plurality of syrup nozzles and a dilution water supply section and that is capable of smoothly cleaning nozzle distal end portions of all syrup nozzles using dilution water.

Solution to Problem

In order to solve the problem mentioned above, a beverage dispenser according to a first aspect of the present invention includes a multivalve that mixes syrup selectively discharged from a plurality of syrup nozzles and dilution water discharged from a dilution water supply section and that supplies the mixture, in which the beverage dispenser further includes a cleaning adapter configured to form a cleaning space in which each syrup nozzle and the dilution water supply section are located between the cleaning adapter and the multivalve and to clean each syrup nozzle by the dilution water discharged from the dilution water supply section, a gap between the cleaning adapter and the multivalve is sealed above a nozzle distal end portion of each syrup nozzle and the dilution water supply section, and the cleaning adapter includes a discharge port that discharges the dilution water after cleaning each syrup nozzle from a position higher than the nozzle distal end portion of each syrup nozzle.

In the beverage dispenser according to a second aspect of the present invention, the multivalve includes: a diffuser in which each syrup nozzle and the dilution water supply section are formed; and a spout detachably attached to outside of the diffuser via an O-ring and configured to guide the dilution water from the dilution water supply section so as to collide with the syrup from the syrup nozzle, in which in a state where the spout is removed, the cleaning adapter is detachably mounted on a mounting portion for detachably mounting the spout, and a gap between the cleaning adapter and the diffuser is sealed by the O-ring above the nozzle distal end portion of each syrup nozzle and the dilution water supply section.

In the beverage dispenser according to a third aspect of the present invention, the cleaning adapter has a shape that follows the syrup nozzles.

In the beverage dispenser according to a fourth aspect of the present invention, the cleaning adapter includes a cylindrical portion whose upper and lower ends are opened and whose top end constitutes the discharge port, while each syrup nozzle is located so as to surround the outside of the cylindrical portion, and the dilution water discharged from the dilution water supply section is discharged from above each syrup nozzle onto an inner peripheral surface of the cleaning adapter.

In the beverage dispenser according to a fifth aspect of the present invention, carbonated water is discharged from the dilution water supply section, and the beverage dispenser includes a function of ejecting carbon dioxide for generating the carbonated water from the dilution water supply section.

Advantageous Effects of Invention

According to the first aspect of the present invention, in a beverage dispenser including a multivalve that mixes syrup selectively discharged from a plurality of syrup nozzles and dilution water discharged from a dilution water supply section and supplies the mixture. The beverage dispenser includes a cleaning adapter for forming a cleaning space in which each syrup nozzle and the dilution water supply section are located between the cleaning adapter and the multivalve and for cleaning each syrup nozzle by the dilution water discharged from the dilution water supply section. In addition, a gap between the cleaning adapter and the multivalve is sealed above the nozzle distal end portion of each syrup nozzle and the dilution water supply section, and the cleaning adapter includes a discharge port that discharges the dilution water after cleaning each syrup nozzle from a position higher than the nozzle distal end portion of each syrup nozzle. Thus, in the state where the cleaning adapter is provided, the dilution water discharged from the dilution water supply section fills the cleaning space without overflowing from above and is discharged from the discharge port located at a position higher than the nozzle distal end portion of each syrup nozzle.

Thus, the dilution water constitutes a continuous flow down to the discharge port via the cleaning space and runs through the nozzle distal end portions of all of the plurality of syrup nozzles, thereby making it possible to smoothly and reliably clean the nozzle distal end portions of all the syrup nozzles.

According to the second aspect of the invention, in addition to the configuration described above, the multivalve includes: a diffuser in which each syrup nozzle and the dilution water supply section are formed; and a spout detachably attached to outside the diffuser via an O-ring to guide the dilution water from the dilution water supply section to collide with the syrup from the syrup nozzles. In addition, in a state where the spout is removed, the cleaning adapter for detachably mounting the spout is detachably mounted on the mounting portion, and a gap between the cleaning adapter and the diffuser is sealed by the O-ring above the nozzle distal end portion of each syrup nozzle and the dilution water supply section. Therefore, the cleaning adapter is mounted using the mounting portion provided for mounting the spout. Furthermore, the cleaning adapter can be sealed using the O-ring provided for sealing a gap between the spout and the diffuser. Accordingly, it is possible to reduce a remarkable number of parts.

Furthermore, according to the third aspect of the invention, in addition to the above aspects of the invention, the cleaning adapter has a shape that follows the syrup nozzles, so that it is possible to thoroughly clean the syrup nozzles from the nozzle distal end portions to the root portions.

According to the fourth aspect of the invention, in particular, in addition to the above aspects of the invention, the cleaning adapter includes a cylindrical portion whose upper and lower ends are opened. In addition, a top end of the cylindrical portion constitutes a discharge port while each syrup nozzle is located so as to surround the outside of the cylindrical portion. The dilution water discharged from the dilution water supply section is discharged from above each syrup nozzle onto an inner peripheral surface of the cleaning adapter, so that the dilution water discharged from the dilution water supply section onto the inner peripheral surface of the cleaning adapter flows from the periphery of each syrup nozzle toward each nozzle distal end portion. After cleaning the nozzles, the dilution water finally reaches the discharge port at the top end of the cylindrical portion located inside each syrup nozzle and is discharged from there. Thus, the cleaning performance of the nozzle distal end portion of each syrup nozzle is further improved, and it is possible to thoroughly clean the syrup nozzles from the nozzle distal end portions to the root portions.

When carbonated water is discharged from the dilution water supply section as in the fifth aspect of the invention, and a function of ejecting carbon dioxide for generating the carbonated water from the dilution water supply section is provided, it is possible to blow off the dilution water remaining at the syrup nozzles by carbon dioxide after cleaning and thus to smoothly perforin draining after cleaning.

DESCRIPTION OF EMBODIMENTS

Figure 1:
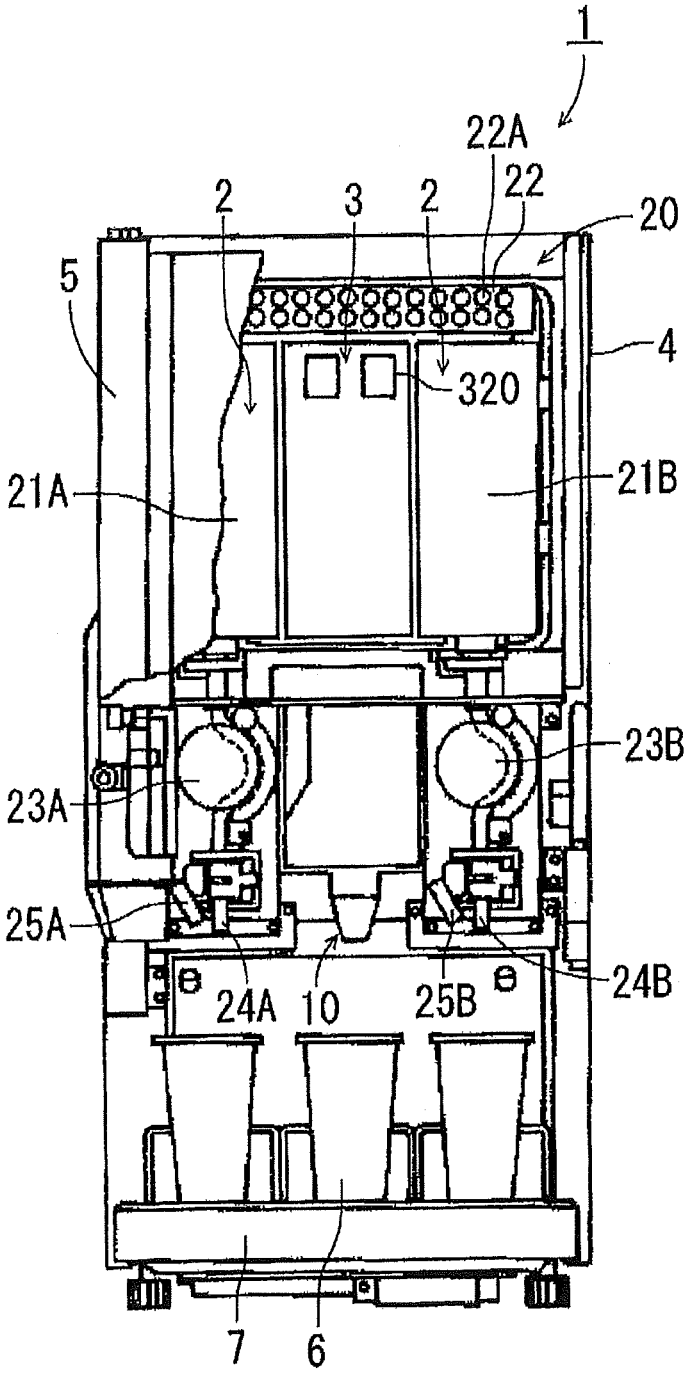
FIG. 1 is a front view of a beverage dispenser according to an embodiment of the present invention.
Figure 2:
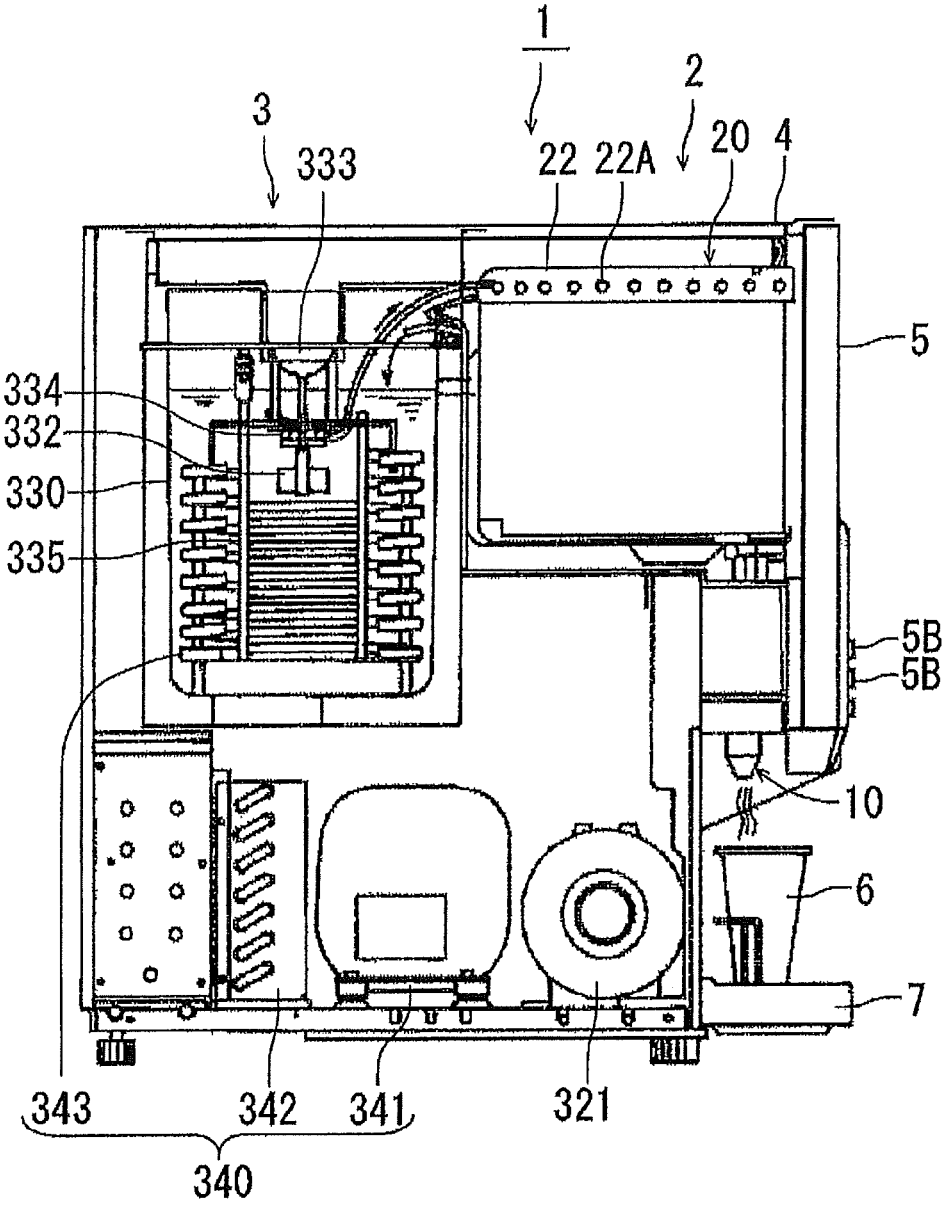
FIG. 2 is a side view of the beverage dispenser in FIG. 1.

Hereinafter, an embodiment of the present invention will be described in detail with reference to the accompanying drawings. Beverage dispenser 1 according to an embodiment includes a non-carbonated beverage supply system 2 that supplies a non-carbonated beverage such as Oolong tea or juice and carbonated beverage supply system 3 that supplies a carbonated beverage such as coke from multivalve 10 according to the present invention. Beverage dispenser 1 includes substantially box-shaped body 4 and door 5 provided with selection switches 5B for selecting a beverage to be supplied, on an upper front surface of body 4. Drip tray 7 on which three cups 6 can be placed is provided at a lower front surface of body 4.

Non-carbonated beverage supply system 2 includes cooling box 20 at a front side of an upper portion of body 4. Cooling box 20 is provided with a pair of right and left BIBs (Bag In Box) 21A and 21B containing syrup (concentrated solution) for non-carbonated beverages and cooler 22 in which continuous S-shaped cooling water conduit 22A is formed and cools the syrup for non-carbonated beverages by causing circulation pump 334, which will be described later, to circulate cooling water in cooling water tank 330 through cooling water conduit 22A of cooler 22.

Non-carbonated beverage supply system 2 includes: a pair of right and left tube pumps 23A and 23B that pressure-feed the syrup for a non-carbonated beverage and cold water which is dilution water from BIBs 21A and 21B; syrup tubes 24A and 24B that discharge the syrup pressure-fed by tube pumps 23A and 23B into cup 6 placed immediately below syrup tubes 24A and 24B; and dilution water nozzles 25A and 25B that discharge dilution water pressure-fed by tube pumps 23A and 23B into cup 6 placed immediately below dilution water nozzles 25A and 25B.

Meanwhile, carbonated beverage supply system 3 includes, in addition to multivalve 10 according to the present invention, a flow rate control valve, and various electromagnetic valves or the like at a center front portion of body 4. In addition, carbonated beverage supply system 3 includes, inside of body 4, booster pump 321 for pressure-feeding tap water from city water (see FIG. 3) 350, cooling water tank (hereinafter referred to as "water tank") 330 containing cooling water and cooling unit 340 that cools the cooling water in water tank 330.

Inside water tank 330, there are arranged: carbonator (see FIG. 3) 331 that generates carbonated water by mixing water and carbon dioxide; agitator motor 333 that agitates cooling water by agitator propeller 332; circulation pump 334 attached to agitator motor 333; coil unit 335 composed of a syrup coil that allows syrup to pass through, a carbonated water coil that allows carbonated water to pass through and a tap water coil that allows tap water to pass through; and evaporator tube 343 that makes up cooling unit 340. Circulation pump 334 and cooling water conduit 22A of cooler 22 are connected together. Thus, agitator motor 333 agitates cooling water in water tank 330 and also pressure-feeds the cooling water in water tank 330 toward the cooling box 20.

Cooling unit 340 includes: compressor 341 that compresses a coolant; condenser 342 that condenses the coolant compressed by compressor 341; and evaporator 343 that evaporates the coolant condensed by condenser 342 and decompressed by a capillary tube or an expansion valve (not shown) or the like and produces cooling performance using heat absorption action in that case.

Figure 3:
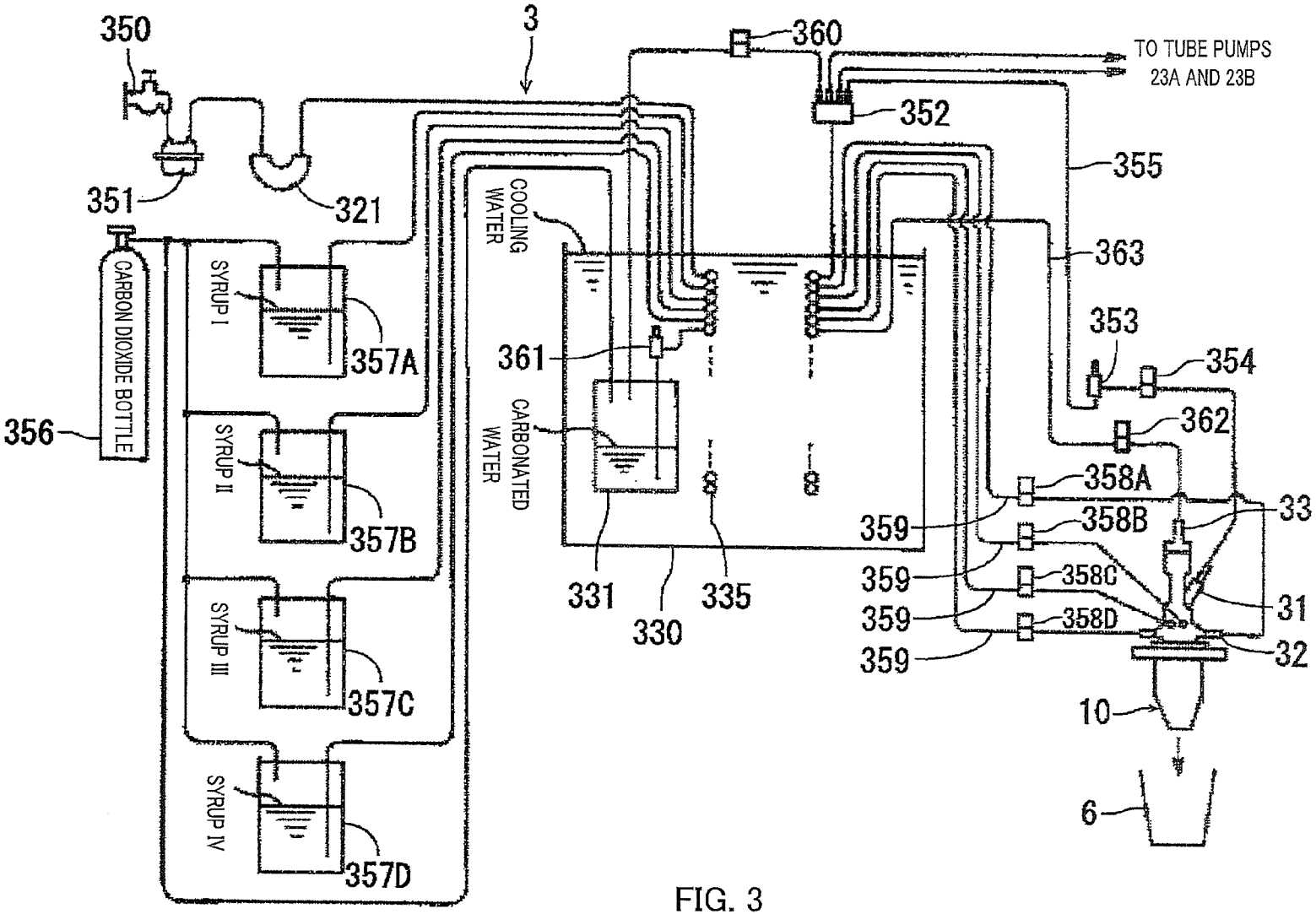
FIG. 3 is a supply flow diagram of a carbonated beverage supply system of the beverage dispenser in FIG. 1.

Next, FIG. 3 illustrates a supply flow of carbonated beverage supply system 3. Conduit 355 is configured such that tap water from city water 350 flows into cold water inlet 31 of multivalve 10 via water filter 351, booster pump 321, coil unit 335, distributor 352, flow rate control valve 353 and electromagnetic valve 354.

Meanwhile, conduit 359 is configured such that carbon dioxide from carbon dioxide bottle 356 is sent to syrup tanks 357A, 357B, 357C and 357D containing a plurality of types (four in the embodiment) of syrup I, II, III and IV differing in flavor, taste, color or the like and the types of syrup I, II, III and IV pressure-fed by carbon dioxide from syrup tanks 357A, 357B, 357C and 357D flow into syrup inlets 32 of multivalve 10 via coil units 335 and electromagnetic valves 358A, 358B, 358C and 358D.

Carbonator 331 is placed in the cooling water in water tank 330. This allows carbonated water to be efficiently generated. This carbonator 331 is supplied with carbon dioxide from carbon dioxide bottle 356 and further supplied with cold water from distributor 352 via carbonator water supply electromagnetic valve 360. Conduit 363 is configured such that carbonated water generated by carbonator 331 flows into carbonated water inflow coupler 33 (to be described later) of multivalve 10 via flow rate control valve 361, coil unit 335 and electromagnetic valve 362.

Figure 4:
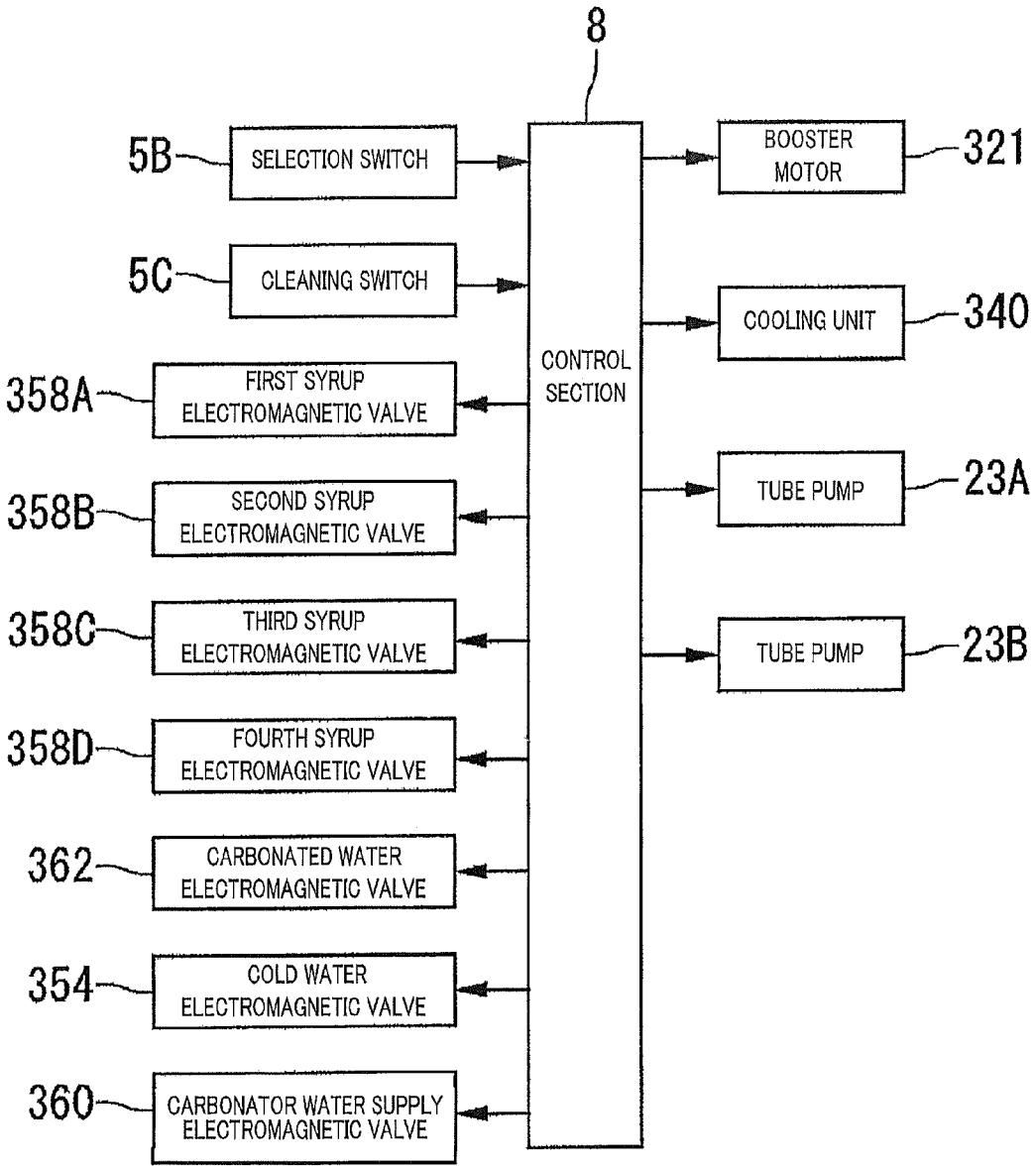
FIG. 4 is a block diagram of a control system of the beverage dispenser in FIG. 1.

Next, FIG. 4 is a block diagram illustrating main parts of a control system of beverage dispenser 1. Beverage dispenser 1 includes control section 8 that takes control of whole beverage dispenser 1 and that is connected to selection switch 5B, first to fourth syrup electromagnetic valves 358A, 358B, 358C and 358D, carbonated water electromagnetic valve 362, cold water electromagnetic valve 354, booster motor 321, cooling unit 340 and tube pumps 23A and 23B. Control section 8 is also connected to cleaning switch 5C provided at a position different from each switch 5B.

Next, a configuration of multivalve 10 according to the present invention will be described with reference to FIG. 5 to FIG. 12. Multivalve 10 of the embodiment is constructed of: carbonated water inflow coupler 33 into which the aforementioned carbonated water flows; resistance piece case 34; diffuser 36; spout 37 whose upper and lower ends are opened and whose bottom end constitutes supply port 47; and base 38. Multivalve 10 is attached to body 4 via mounting plate 39.

Resistance piece case 34 is connected to carbonated water inflow coupler 33 which is screwed to a top end of resistance piece case 34. Resistance piece case 34 also houses resistance piece 42 that decompresses a pressure of carbonated water from inlet 41 of carbonated water inflow coupler 33. Cold water inlet 31 through which cold water flows inside is formed so as to protrude diagonally upward. Resistance piece 42 includes a plurality of grooves formed in an axial direction in a circumferential surface of resistance piece 42 and is configured such that the resistance value is changeable by changing the depth of the grooves. Resistance piece case 34 is configured such that carbonated water from inlet 41 of carbonated water inflow coupler 33 is decompressed by this resistance and a carbonated beverage of good quality can be supplied. Resistance piece case 34 forms carbonated water channel 43 that communicates with inlet 41 of carbonated water inflow coupler 33, and resistance piece 42 is housed in this carbonated water channel 43. Cold water inlet 31 communicates with a lower end portion of carbonated water channel 43.

Diffuser 36 is attached below resistance piece case 34, a plurality of syrup inlets 32 through which syrup is introduced from a medium stage are formed in a horizontal direction to diffuse the syrup from syrup inlet 32 and the carbonated water and cold water from resistance piece case 34. A plurality of syrup nozzles 44 (four in the embodiment) are formed so as to protrude downward from the vicinity of the center of the lower end portion of diffuser 36. Syrup inlets 32 are configured to communicate with syrup nozzles 44 via independent syrup channels 46, respectively.

Figure 10:
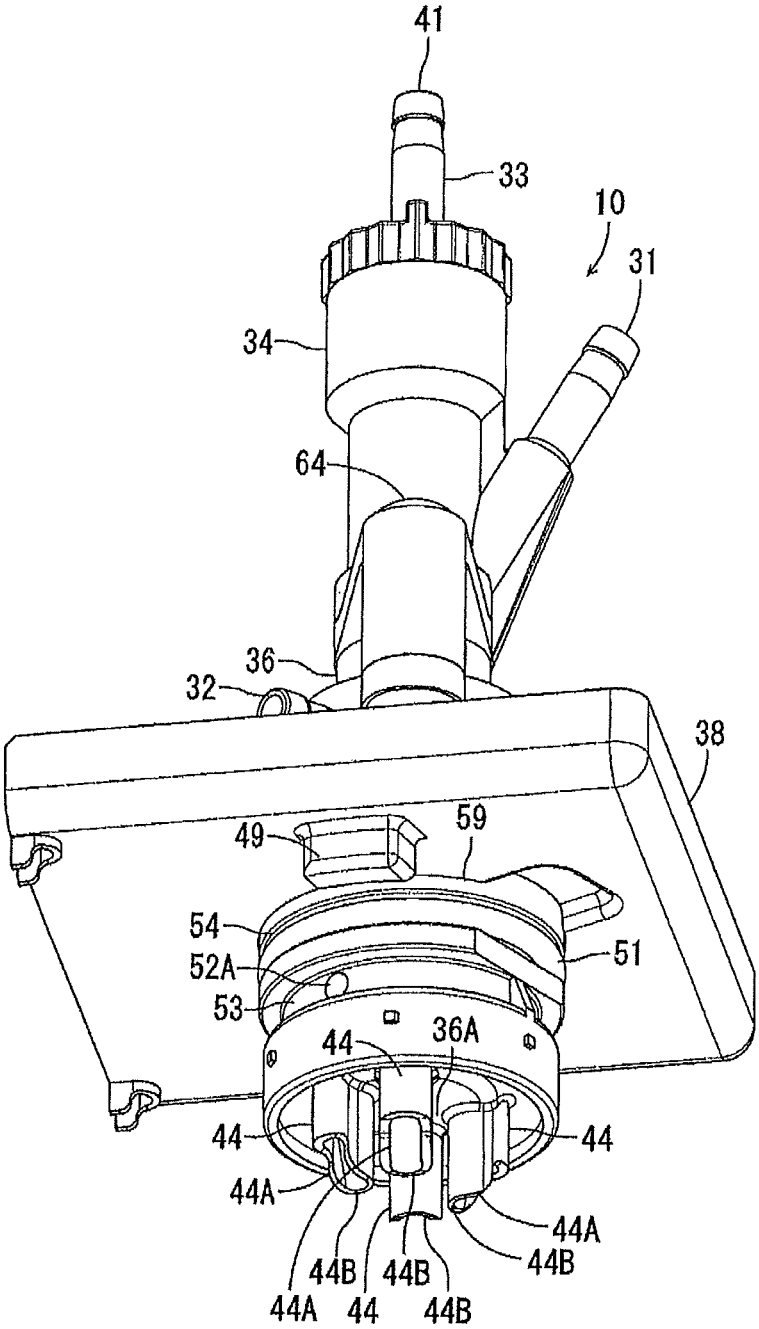
FIG. 10 is a lower perspective view of the multivalve in FIG. 8 with the spout removed.
Figure 11:
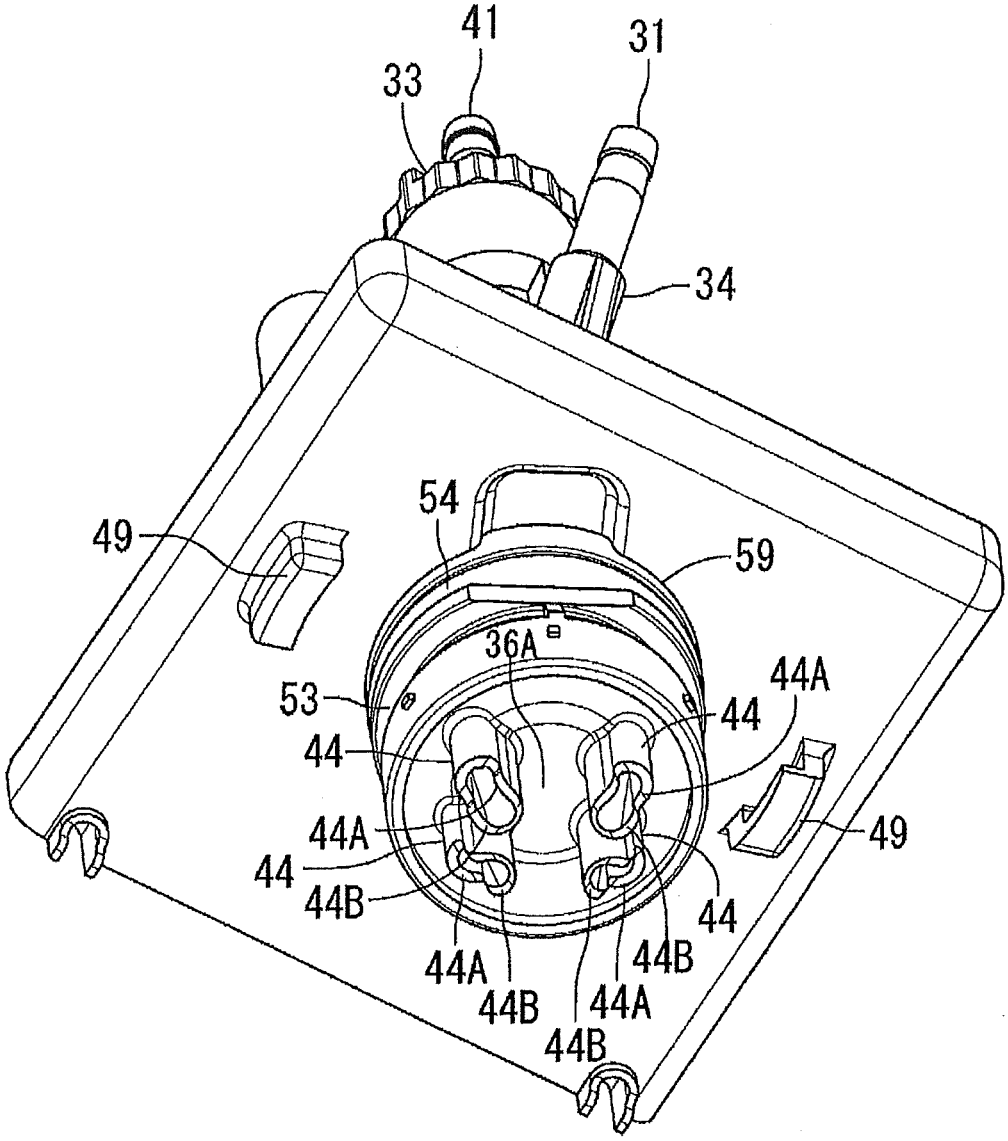
FIG. 11 is another lower perspective view of the multivalve in FIG. 10.

In this case, each syrup nozzle 44 is located above supply port 47 of spout 37 and includes nozzle distal end portion 44A formed with an angle so as to supply the syrup to a central part or the vicinity of supply port 47 of spout 37. Four syrup nozzles 44 are formed so as to protrude close to each other and arranged at positions of vertices of a rectangle as shown in FIG. 10 and FIG. 11.

Note that, since four syrup nozzles 44 are provided in the embodiment, syrup nozzles 44 are arranged at positions of the vertices of a rectangle, respectively, but when, for example, three types of syrup are supplied and thus, there are three syrup nozzles 44, syrup nozzles 44 are arranged at positions of the vertices of a triangle, respectively, or when many types (five or more types) of syrup are supplied and thus, there are five or more syrup nozzles 44, syrup nozzles 44 are arranged at positions of the vertices of a pentagon, hexagon or the like, respectively.

Figure 12:
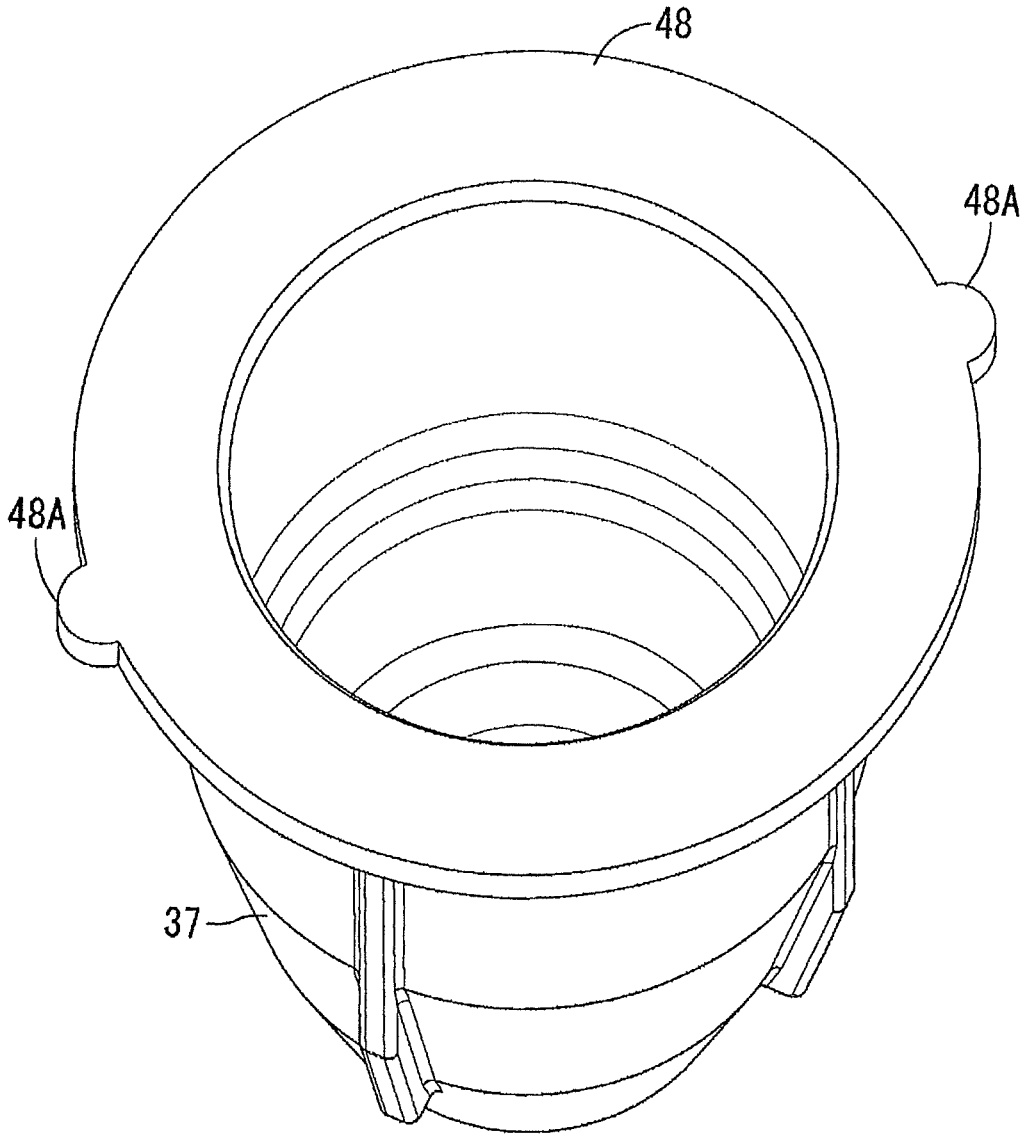
FIG. 12 is a perspective view of the spout of the multivalve in FIG. 8.

Spout 37 is detachably attached to base 38 by causing two protruding pieces 48A formed on flange 48 of an opening edge at the top end of spout 37 as shown in FIG. 12 to removably engage with two mounting portions 49 formed on an undersurface of base 38. At this time, spout 37 is brought into contact with the circumference of diffuser 36 via O-ring 51, mixes the syrup from diffuser 36 with carbonated water or cold water (both are dilution water) and supplies the mixture from supply port 47 to cup 6.

In this case, inverted T-shaped dilution water channel 52 is formed downward from the center of the top portion in diffuser 36, and the top end of dilution water channel 52 communicates with carbonated water channel 43. Dilution water supply section 53 is formed in a groove-like recessed shape in the circumference of diffuser 36 above each syrup nozzle 44 and the lower end of dilution water channel 52 communicates with this dilution water supply section 53 at two positions facing each other. Mounting groove 54 for mounting O-ring 51 is formed in the circumference of a portion of diffuser 36 above dilution water supply section 53 and below the bottom surface of base 38 when diffuser 36 is fixed to base 38 (FIG. 10, FIG. 11). In this way, dilution water supply section 53 is positioned below mounting groove 54.

When spout 37 is mounted on base 38, the inner peripheral surface of the top end portion of spout 37 is brought into contact with O-ring 51, thus sealing a gap between the spout 37 and diffuser 36. Spout 37 forms gap G between spout 37 and diffuser 36 in the portion below dilution water supply section 53, and dilution water (carbonated water, cold water) passing through gap G and coming out of dilution water supply section 53 flows down along the inner surface of spout 37 toward supply port 47. Dilution water supply section 53 and dilution water channel 52 communicate with each other at communication section 52A.

Spout 37 is configured to mix the syrup discharged from each syrup nozzle 44 of the diffuser with the dilution water (carbonated water or cold water) discharged from dilution water supply section 53 and to supply the mixture from supply port 47 to cup 6 and the lower part of spout 37 is narrower than the upper part thereof. Nozzle distal end portion 44A of each syrup nozzle 44 includes protrusion 44B to allow the subsequently dripping syrup to drip from the center side, and the opening diameter of the opening edge of supply port 47 is expanded so that the opening edge becomes at least the outside of protrusion 44B of nozzle distal end portion 44A of each syrup nozzle 44. Thus, it is designed to prevent the subsequently dripping syrup from dripping down along the inner surface of spout 37.

Figure 5:
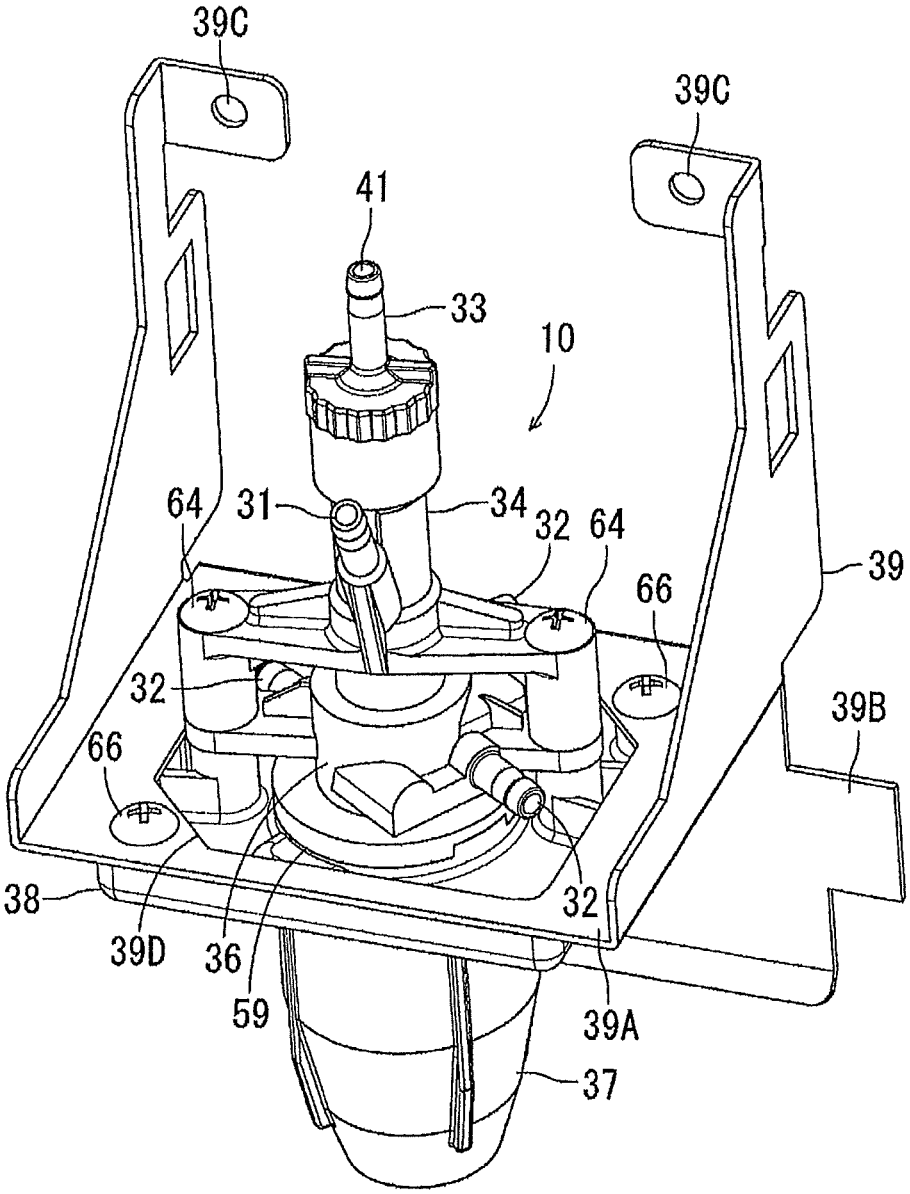
FIG. 5 is a perspective view of a multivalve mounted on a mounting plate of the beverage dispenser in FIG. 1.
Figure 6:
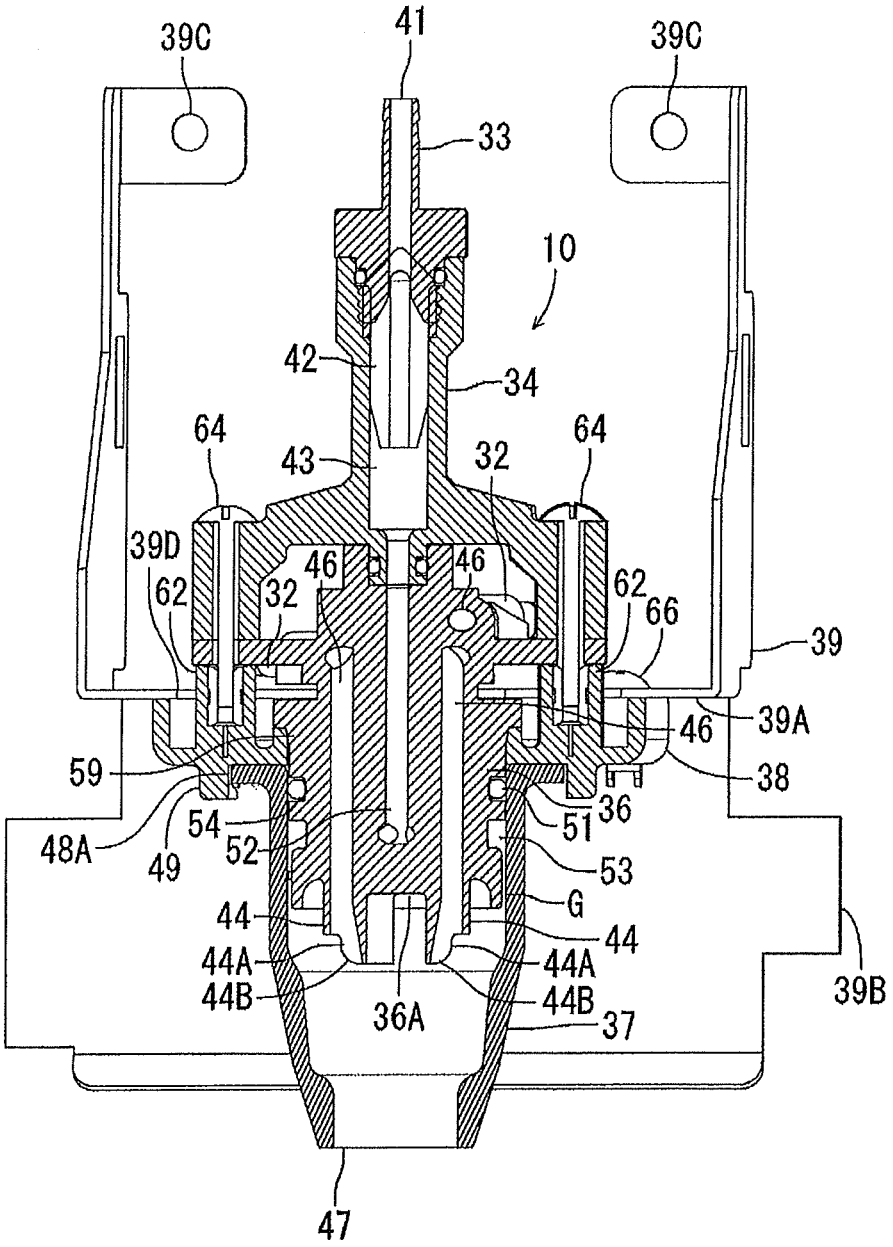
FIG. 6 is a longitudinal sectional front view of the mounting plate and the multivalve in FIG. 5.
Figure 7:
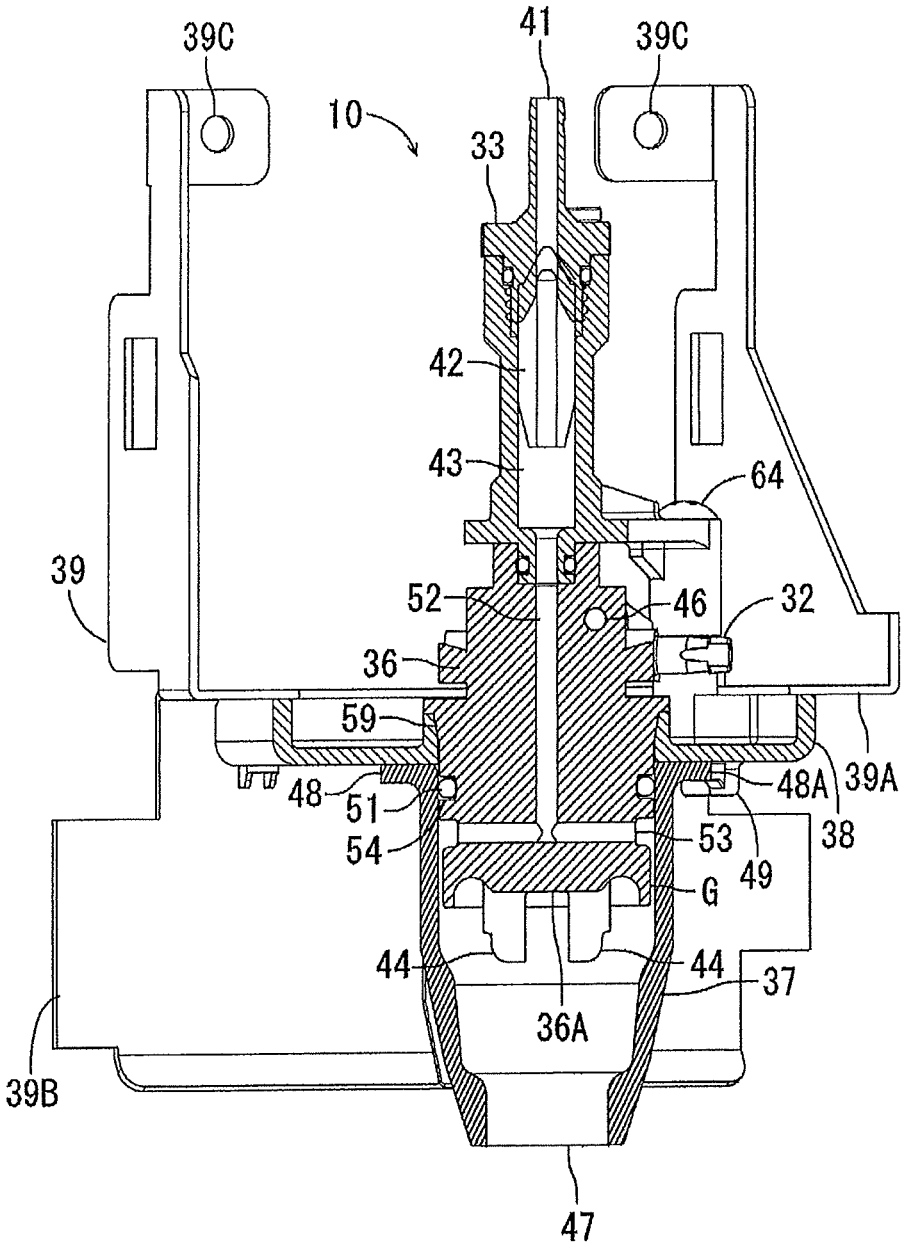
FIG. 7 is a longitudinal sectional side view of the mounting plate and the multivalve in FIG. 5.

Meanwhile, mounting plate 39 is constructed of horizontal wall 39A, vertical wall 39B hanging down from the rear end of this horizontal wall 39A and mounting portions 39C to be attached to body 4, and through-hole 39D is formed in horizontal wall 39A where multivalve 10 is arranged (FIG. 5 to FIG. 7). This mounting plate 39 is mounted on body 4 by means of mounting portions 39C. Vertical wall 39B is located above the back portion of drip tray 7.

Figure 8:
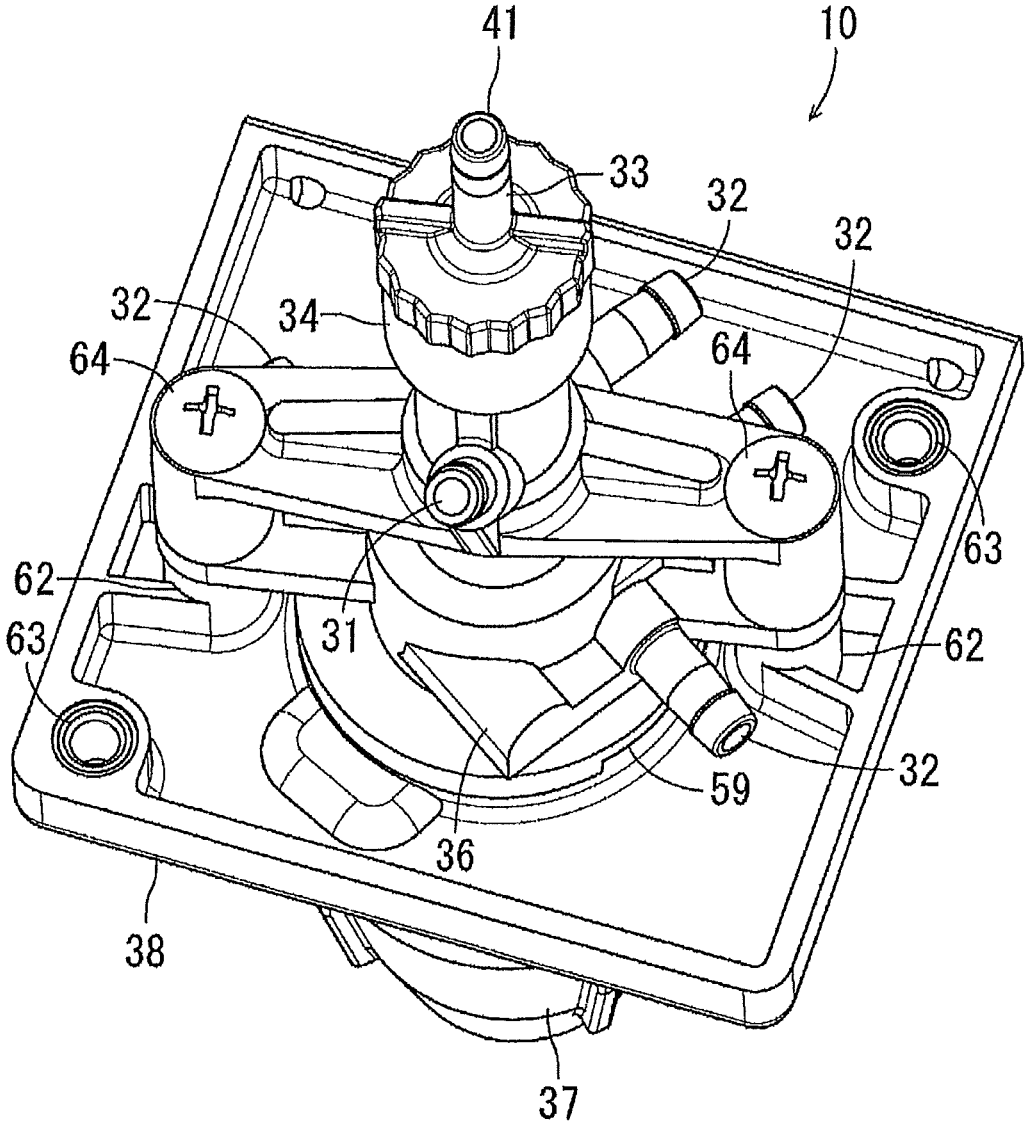
FIG. 8 is a perspective view of the multivalve of the beverage dispenser in FIG. 1.
Figure 9:
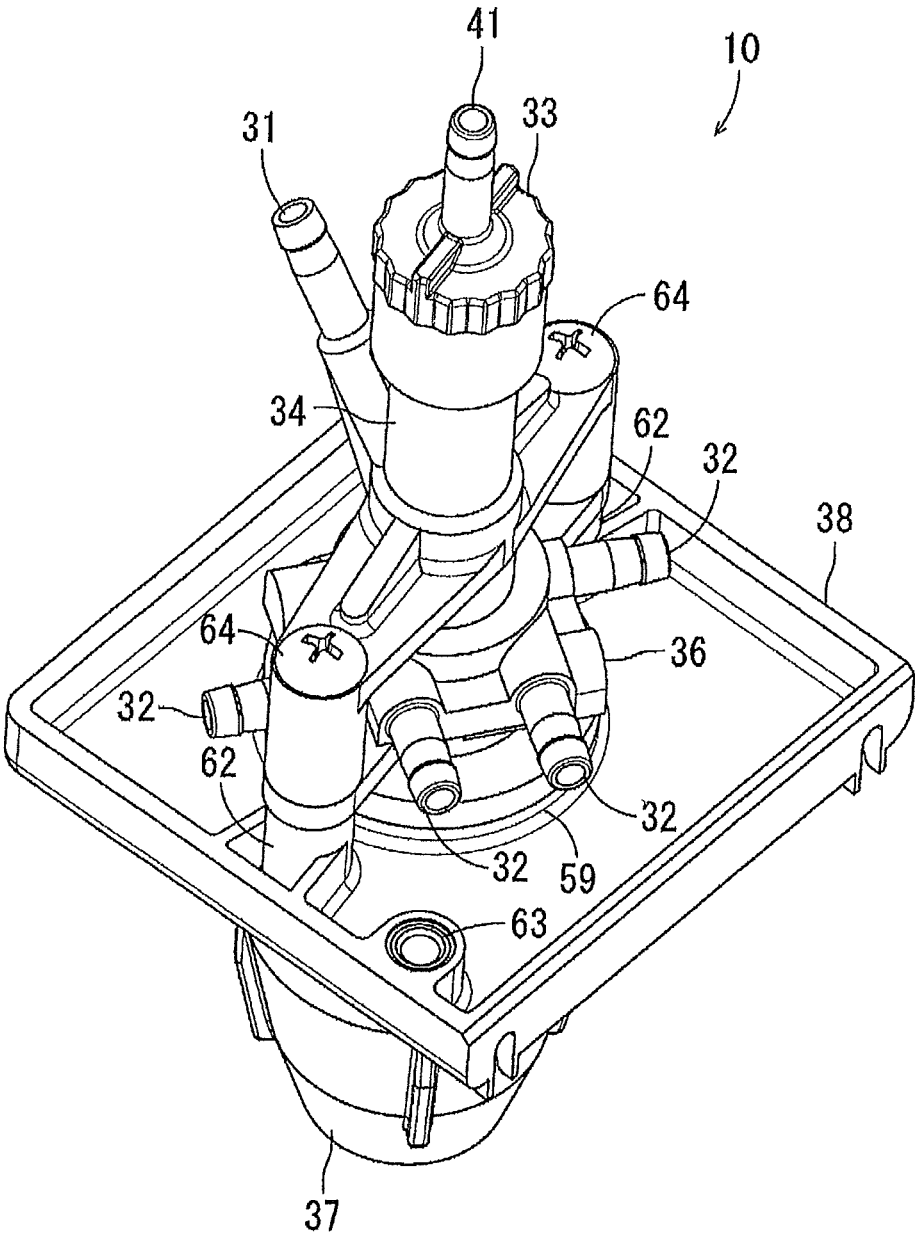
FIG. 9 is a rear perspective view of the multivalve in FIG. 8.

Base 38 is arranged below horizontal wall 39A of mounting plate 39. As shown in FIG. 8 and FIG. 9, base 38 as a whole has a rectangular shape. Through-hole 59 where diffuser 36 passes through is formed at the center of base 38. Base 38 includes two screwing parts 62 formed to join resistance piece case 34, diffuser 36 and base 38 and two screwing parts 63 are formed to fix base 38 to mounting plate 39 at positions apart from screwing parts 62.

When multivalve 10 is mounted on mounting plate 39 in the configuration described above, resistance piece 42 is housed in resistance piece case 34 first, carbonated water inflow coupler 33 is connected next, and in this condition, diffuser 36 is coupled to mounting plate 39 to connect all these components. At this time, O-ring 51 is not attached yet. Next, diffuser 36 is inserted into through-hole 59 of base 38, and in this condition, resistance piece case 34 and diffuser 36 are fixed to screwing parts 62 of base 38 from above using screws 64. O-ring 51 is attached to mounting groove 54 in this condition, In this way, after resistance piece case 34, diffuser 36 and base 38 are assembled, resistance piece case 34 and diffuser 36 are made to pass through through-hole 39D formed in horizontal wall 39A of mounting plate 39, from below, and with base 38 brought into contact with the undersurface of horizontal wall 39A, screws 66 are inserted into horizontal wall 39A from above are inserted into screwing parts 63 and tightened to fix base 38 to mounting plate 39. Thus, base 38 is attached to the underside of horizontal wall 39A of mounting plate 39, and multivalve 10 is mounted on mounting plate 39 of body 4 while diffuser 36 and resistance piece case 34 are positioned above horizontal wall 39A via through-hole 39D of mounting plate 39.

Next, spout 37 is positioned at the lower portion of diffuser 36 in such a way that the lower portion of diffuser 36 (dilution water supply section 53 and syrup nozzle 44) is inserted into spout 37. At this time, protruding pieces 48A are placed at positions shifted from mounting portions 49 of base 38 first, and spout 37 is then turned clockwise as viewed from below so as to cause protruding pieces 48A to engage with mounting portions 49 and thus to detachably attach spout 37 to base 38. Multivalve 10 according to the present invention is thus completed. In this condition, gap G between spout 37 and diffuser 36 is sealed by O-ring 51 above dilution water supply section 53.

Next, a beverage supply operation by beverage dispenser 1 in the above configuration will be described. Control section 8 controls booster motor 321, agitator motor 333, circulation pump 334 and cooling unit 340 to cool the cooling water in water tank 330 to cool cooling box 20. When selection switch 5B is pressed in a state where the cooling water in water tank 330 and the syrup in cooling box 20 are cooled down to temperatures low enough to supply the water and syrup, control section 8 performs control of supplying a non-carbonated beverage or carbonated beverage selected by selection switch 5B.

Here, a description will be given of a case where a carbonated beverage is supplied. Based on the pressing of selection switch 5B, control section 8 controls a corresponding one or more of electromagnetic valves 358A to 358D, and 362 and 354 to pressure-feed a beverage composed of any one of types of syrup I to IV, and carbonated water and cold water, a beverage composed of one type of syrup and carbonated water or a beverage composed of one type of syrup and cold water to multivalve 10, and to pour the beverage into cup 6 placed at the center of drip tray 7.

At this time, syrup (one of types of syrup I, II, III and IV) pressure-fed by carbon dioxide from a corresponding one of syrup tanks 357A, 357B, 357C and 357D is cooled by cooling water at coil unit 335, passes through conduit 359 and flows into corresponding syrup inlet 32 formed in diffuser 36 of multivalve 10 via a corresponding one of electromagnetic valves 358A, 358B, 358C and 358D. The syrup that has flowed into syrup inlet 32 reaches syrup nozzle 44 via syrup channel 46 in diffuser 36 and is discharged from nozzle distal end portion 44A.

In this case, since nozzle distal end portion 44A of each syrup nozzle 44 is configured at an angle such that the syrup is supplied to the center portion or in the vicinity of supply port 47 of spout 37 as described above, the syrup is discharged at the center portion or in the vicinity of supply port 47 of spout 37 from nozzle distal end portion 44A of syrup nozzle 44.

Meanwhile, carbonated water generated by carbonator 331 passes through flow rate control valve 361, coil unit 335 and conduit 363, flows into inlet 41 of carbonated water inflow coupler 33 of multivalve 10 via electromagnetic valve 362 and is decompressed by resistance piece 42 in carbonated water channel 43 in resistance piece case 34. Cold water passes through booster pump 321 of conduit 355, coil unit 335, distributor 352, flow rate control valve 353 and electromagnetic valve 354, then flows into cold water inlet 31 of resistance piece case 34 and reaches the inside of carbonated water channel 43.

Figure 13:
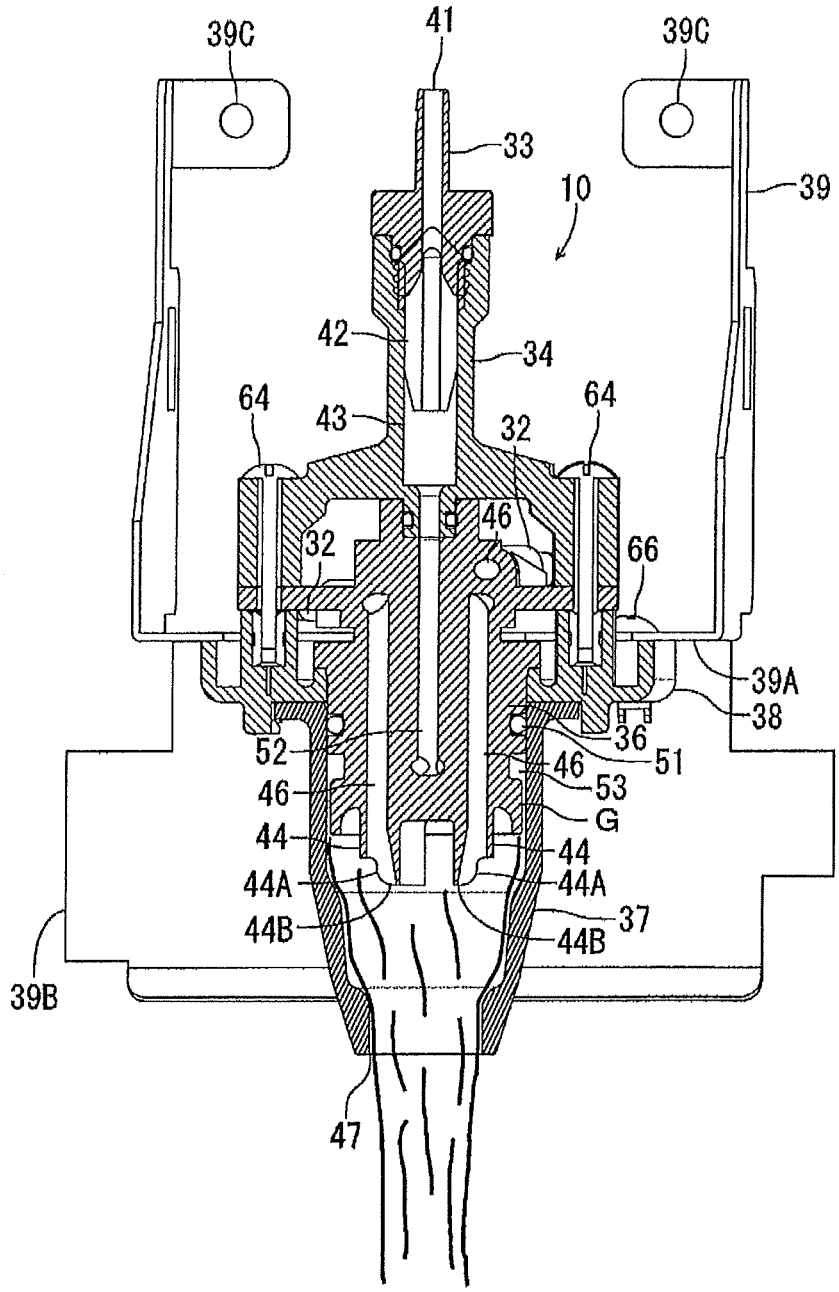
FIG. 13 illustrates a flow of dilution water of the multivalve in FIG. 6.

The dilution water (carbonated water, cold water) that has flowed into carbonated water channel 43 of resistance piece case 34 passes through dilution water channel 52 in diffuser 36 and is discharged onto the inner peripheral surface of spout 37 from dilution water supply section 53 formed on the circumference thereof. The dilution water (carbonated water or cold water) at this time flows in a manner illustrated in FIG. 13.

That is, the dilution water (carbonated water, cold water) discharged from dilution water supply section 53 onto the inner peripheral surface of spout 37 flows down through gap G between diffuser 36 and spout 37. The dilution water then collides with the syrup from syrup nozzle 44, is mixed therewith and supplied to cup 6.

Figure 14:
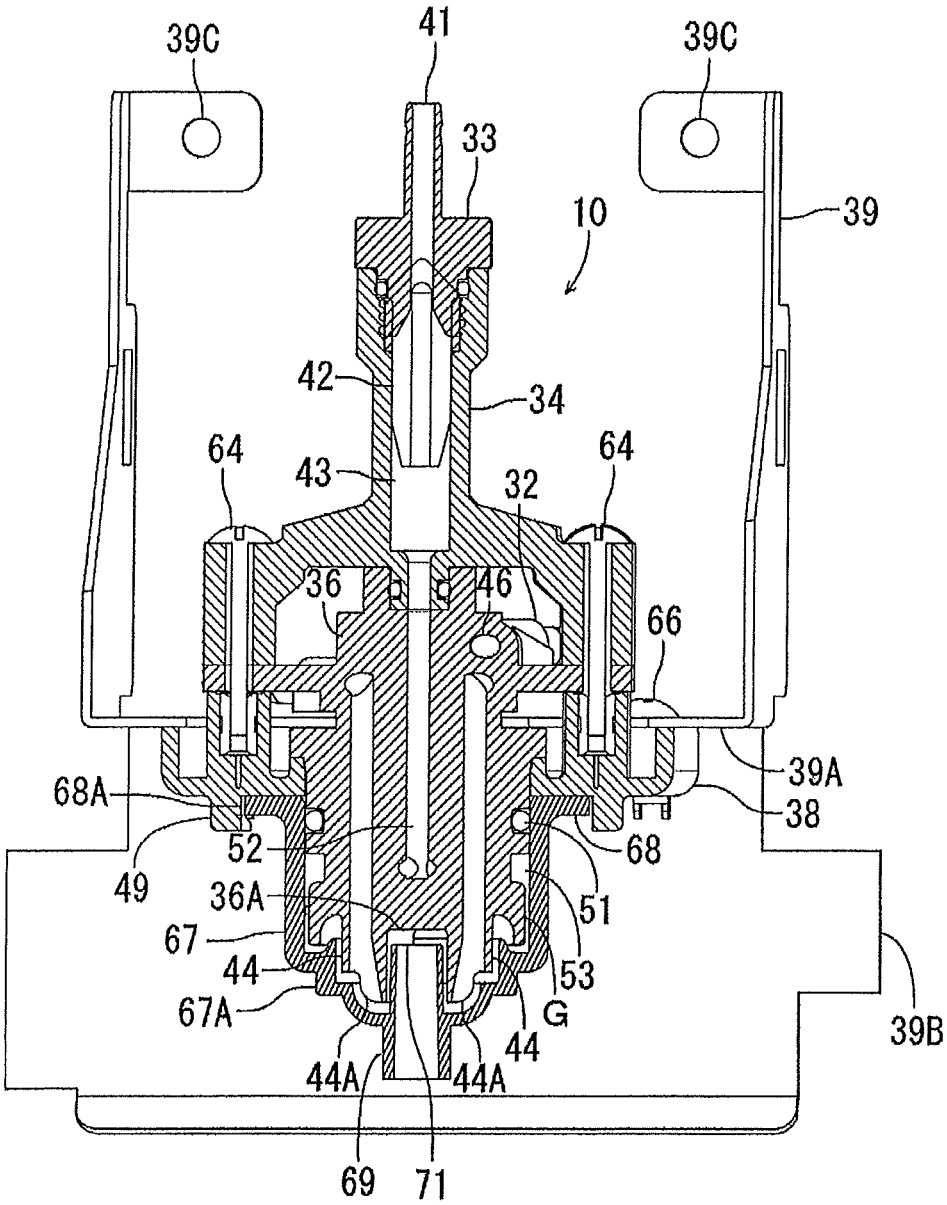
FIG. 14 illustrates the multivalve in FIG. 6 with the spout removed and with a cleaning adapter attached.

Next, the cleaning operation and work of multivalve 10 will be described with reference to FIG. 14. Through the aforementioned beverage supply operation, the syrup attaches to nozzle distal end portion 44A or nozzle root portion of syrup nozzle 44 of diffuser 36 of multivalve 10, remains there and is fixed thereto. For this reason, a state is created in which bacteria easily reproduce, and therefore the cleaning operation and cleaning work are periodically carried out.

When performing the cleaning operation of beverage dispenser 1, spout 37 is first turned counterclockwise as viewed from below to cause protruding pieces 48A to disengage from mounting portions 49 to remove spout 37 from base 38. Next, cleaning adapter 67 is attached to base 38. This cleaning adapter 67 is prepared for beverage dispenser 1 of the present invention, includes flange 68 and protruding pieces 68A similar to spout 37 in an opening at the top edge of cleaning adapter 67 as shown in FIG. 14, and bottom wall 67A has a shape that follows each syrup nozzle 44.

Cylindrical portion 69 having a cylindrical shape whose top and bottom ends are opened is formed at the center lower end portion of bottom wall 67A. This cylindrical portion 69 protrudes above and below bottom wall 67A of cleaning adapter 67, and the opening at the upper end portion constitutes discharge port 71 of cleaning adapter 67.

Cleaning adapter 67 having such a shape is attached to base 38 using a method similar to that used for spout 37. That is, cleaning adapter 67 is placed at the lower portion of diffuser 36 by inserting the lower portion of diffuser 36 (dilution water supply section 53 and syrup nozzle 44) into cleaning adapter 67. At this time, protruding pieces 68A are placed at positions shifted from mounting portions 49 of base 38, cleaning adapter 67 is turned clockwise as viewed from below to cause protruding pieces 68A to engage with mounting portions 49 and to detachably attach cleaning adapter 67 to base 38.

The state described above is illustrated in FIG. 14. In this state, similar gap G is formed between cleaning adapter 67 and diffuser 36, and this gap G constitutes a cleaning space in which syrup nozzle 44 and dilution water supply section 53 are located. This gap G is sealed by O-ring 51 above syrup nozzle 44 and dilution water supply section 53. Cylindrical portion 69 enters the inside of each syrup nozzle 44 arranged at a corresponding vertex of the rectangle so as to face bottom wall surface 36A of diffuser 36 at a certain distance therefrom. This causes each syrup nozzle 44 to be located so as to surround the outside of cylindrical portion 69. Discharge port 71 is open at a position higher than nozzle distal end portions 44A of all syrup nozzles 44.

Thus, in a state where cleaning adapter 67 is attached to base 38, an appropriate container (which may be cup 6) is placed at the center of drip tray 7, and aforementioned cleaning switch 5C is pressed. When cleaning switch 5C is pressed, control section 8 causes the carbonated water (dilution water) generated by carbonator 331 to pass through flow rate control valve 361, coil unit 335 and conduit 363 and then to flow into inlet 41 of carbonated water inflow coupler 33 of multivalve 10 via electromagnetic valve 362, and to be discharged from dilution water supply section 53 formed on the circumference of diffuser 36 onto the inner peripheral surface of cleaning adapter 67.

At this time, since cleaning adapter 67 and diffuser 36 are sealed by O-ring 51 above dilution water supply section 53, the carbonated water (dilution water) discharged from dilution water supply section 53 fills gap G (cleaning space) without overflowing from above and is discharged from discharge port 71 of cylindrical portion 69 at a position higher than nozzle distal end portion 44A of each syrup nozzle 44 into the container below.

This causes carbonated water (dilution water) to circulate all nozzle distal end portions 44A and nozzle root portions of respective syrup nozzles 44, making it possible to smoothly and reliably clean nozzle distal end portions 44A and nozzle root portions of all syrup nozzles 44.

In the embodiment, cleaning adapter 67 can be attached using mounting portion 49 provided for attaching spout 37 to base 38, and further cleaning adapter 67 can be sealed using also O-ring 51 provided for sealing the gap between spout 37 and diffuser 36. Accordingly, it is possible to reduce a remarkable number of parts.

Furthermore, since bottom wall 67A of cleaning adapter 67 has a shape that follows syrup nozzles 44, it is possible to thoroughly clean nozzle distal end portions 44A of syrup nozzles 44 by carbonated water (dilution water).

In the embodiment in particular, since the upper end of cylindrical portion 69 constitutes discharge port 71 and each syrup nozzle 44 is located in such a way as to surround the outside of cylindrical portion 69, carbonated water (dilution water) discharged from dilution water supply section 53 onto the inner peripheral surface of cleaning adapter 67 flows from the periphery of syrup nozzles 44 to nozzle distal end portions 44A. After cleaning nozzle distal end portions 44A, the carbonated water finally reaches discharge port 71 at the upper end of cylindrical portion 69 located inside of each syrup nozzle 44 and is discharged from there. Therefore, the cleaning performance of nozzle distal end portion 44A of each syrup nozzle 44 and the nozzle root portion further improves.

Note that the cleaning operation is executed by control section 8 for a predetermined time and then finished. After the cleaning operation, when control section 8 is provided with a function capable of ejecting carbon dioxide from carbon dioxide bottle 356 from dilution water supply section 53 of multivalve 10, and a conduit configuration is adopted for that purpose in a state where cleaning adapter 67 is attached, it is possible to blow off carbonated water (dilution water) remaining in syrup nozzles 44 after the cleaning by carbon dioxide, and thus to smoothly perform draining after the cleaning.

In the embodiment, base 38 of multivalve 10 is provided below horizontal wall 39A of mounting plate 39, but base 38 may be provided above horizontal wall 39A. In this case, the mounting portion for mounting spout 37 or cleaning adapter 67 may be formed on the undersurface of horizontal wall 39A of mounting plate 39.

REFERENCE SIGNS LIST

G Gap (cleaning space: carbonated water (dilution water) channel)
1 Beverage dispenser
4 Body
10 Multivalve
34 Resistance piece case
36 Diffuser
37 Spout
38 Base
39 Mounting plate
44 Syrup nozzle
49 Mounting portion
51 O-ring
53 Dilution water supply section
67 Cleaning adapter
69 Cylindrical portion
71 Discharge port

The invention claimed is:

1. A beverage dispenser comprising a multivalve that mixes syrup selectively discharged from a plurality of syrup nozzles and dilution water discharged from a dilution water supply section and that supplies the mixture, wherein the beverage dispenser further comprises a cleaning adapter configured to form a cleaning space in which each syrup nozzle and the dilution water supply section are located between the cleaning adapter and the multivalve and to clean each syrup nozzle by the dilution water discharged from the dilution water supply section, the cleaning space between the cleaning adapter and the multivalve is sealed above a nozzle distal end portion of each syrup nozzle and the dilution water supply section, the cleaning adapter includes a discharge port that discharges the dilution water after cleaning each syrup nozzle from a position higher than the nozzle distal end portion of each syrup nozzle, the multivalve includes: a diffuser in which each syrup nozzle and the dilution water supply section are formed; and a spout detachably attached to outside of the diffuser via an O-ring and configured to guide the dilution water from the dilution water supply section so as to collide with the syrup from the syrup nozzle, and in a state where the spout is removed, the cleaning adapter is detachably mounted on a mounting portion for detachably mounting the spout, and a gap between the cleaning adapter and the diffuser is sealed by the O-ring above the nozzle distal end portion of each syrup nozzle and the dilution water supply section.

2. The beverage dispenser according to claim 1, wherein the cleaning adapter has a shape that follows the syrup nozzles.

3. The beverage dispenser according to claim 1, wherein the cleaning adapter includes a cylindrical portion whose upper and lower ends are opened and whose top end constitutes the discharge port, while each syrup nozzle is located so as to surround the outside of the cylindrical portion, and the dilution water discharged from the dilution water supply section is discharged from above each syrup nozzle onto an inner peripheral surface of the cleaning adapter.

4. The beverage dispenser according to claim 1, wherein carbonated water is discharged from the dilution water supply section, and the beverage dispenser includes a function of ejecting carbon dioxide for generating the carbonated water from the dilution water supply section.

* * * * *